US010006709B2

(12) United States Patent
Suominen

(10) Patent No.: US 10,006,709 B2
(45) Date of Patent: Jun. 26, 2018

(54) NOZZLE OF A DEVICE FOR CONTACT—FREE TREATMENT OF A RUNNING FIBER WEB

(71) Applicant: Valmet Technologies Oy, Espoo (FI)

(72) Inventor: Mikko Suominen, Nousiainen (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days. days.

(21) Appl. No.: 15/630,932

(22) Filed: Jun. 22, 2017

(65) Prior Publication Data

US 2017/0370644 A1 Dec. 28, 2017

(30) Foreign Application Priority Data

Jun. 23, 2016 (EP) ..... 16175902

(51) Int. Cl.

| | |
|---|---|
| ***F26B 13/20*** | (2006.01) |
| ***B65H 23/24*** | (2006.01) |
| ***D21F 5/18*** | (2006.01) |
| ***D21H 25/06*** | (2006.01) |
| *B65H 51/16* | (2006.01) |

(52) U.S. Cl.

CPC ..... *F26B 13/104* (2013.01); *B65H 23/24* (2013.01); *D21F 5/187* (2013.01); *D21H 25/06* (2013.01); *B65H 51/16* (2013.01); *B65H 2406/112* (2013.01)

(58) Field of Classification Search

CPC ..... F26B 13/104; B65H 23/24; B65H 51/16; B65H 2406/112; D21F 5/187; D21H 25/06

USPC ..... 34/641; 162/358.1

See application file for complete search history.

(56) References Cited

U.S. PATENT DOCUMENTS

| | | | | |
|---|---|---|---|---|
| 3,303,576 A * | 2/1967 | Sisson | D21F 5/00 | 162/207 |
| 3,972,127 A * | 8/1976 | Hoshi | D02J 13/00 | 34/266 |
| 4,292,745 A | 10/1981 | Caratsch | | |
| 4,952,128 A * | 8/1990 | Marshall | A61F 13/15658 | 156/62.4 |
| 5,230,165 A | 7/1993 | Beisswanger | | |

(Continued)

FOREIGN PATENT DOCUMENTS

| | | |
|---|---|---|
| DE | 2934967 A1 | 3/1980 |
| DE | 202012005534 U1 | 7/2012 |

(Continued)

OTHER PUBLICATIONS

European Search Report for EP16175902 dated Sep. 28, 2016.

*Primary Examiner* — Stephen M Gravini
(74) *Attorney, Agent, or Firm* — Stiennon & Stiennon

(57) ABSTRACT

A nozzle (10) for contact-free treatment of a running web, having a main frame (11) forming an outer part of the nozzle, and two side chambers (14, 15) on each of the longitudinal sides of the nozzle (10). The side chambers having openings (17A, 17B, 16A, 16B) for the air to blow toward a fiber web. A U-shaped air channel (20), through which the air is lead to the side chambers (14, 15), located between the side chambers (14, 15), having at least one opening (19, 18) on each side wall for leading the air into the side chambers (14, 15). A U-shaped inner part (13) which is movable by a mechanism (12) comprising a screw (21) and bushings (22) to at least partially open and close the opening (18, 19).

12 Claims, 3 Drawing Sheets

(56) References Cited

U.S. PATENT DOCUMENTS 5,519,945 A * 5/1996 Ahvenniemi ..... B08B 3/022 15/345
5,524,355 A * 6/1996 Schiel ..... D21F 1/48 165/90
5,588,223 A * 12/1996 Marshall ..... D21F 5/181 34/111
5,771,602 A * 6/1998 Heikkila ..... D21H 25/06 34/114
5,845,415 A * 12/1998 Sundqvist ..... D21F 5/00 34/452
5,950,329 A * 9/1999 Lehtinen ..... D21G 1/006 34/392
5,974,691 A * 11/1999 Marchal ..... D21F 5/20 34/122
6,119,362 A * 9/2000 Sundqvist ..... D21F 5/18 34/120
6,286,229 B1 * 9/2001 Simolin ..... B27N 3/086 34/394
6,314,659 B1 * 11/2001 Parker ..... D21F 1/30 34/114
6,485,612 B1 * 11/2002 Graf ..... D21F 3/0209 100/153
6,598,315 B1 7/2003 Heikkilaet et al.
9,206,549 B2 * 12/2015 Cederloef ..... F26B 13/183
2010/0276101 A1 * 11/2010 Tamai ..... D21B 1/32 162/358.1
2017/0370644 A1 * 12/2017 Suominen ..... F26B 13/104

FOREIGN PATENT DOCUMENTS

EP 0 606 829 A2 * 7/1994 ..... B65H 23/02
EP 0726220 A2 8/1996
GB 2245256 A 1/1992
GB 2272390 A * 5/1994 ..... B05C 5/0283
JP 2001115383 A * 4/2001 ..... D21F 1/325
JP 2002273272 A 9/2002
WO WO 9534713 A1 * 12/1995 ..... E21F 9/003
WO 0102643 A1 1/2001

* cited by examiner

NOZZLE OF A DEVICE FOR CONTACT—FREE TREATMENT OF A RUNNING FIBER WEB

CROSS REFERENCES TO RELATED APPLICATIONS

This application claims priority on EP 16175902 filed on Jun. 23, 2016 which is incorporated herein by reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to fiber web technology. More especially the invention relates to a nozzle of a device for contact-free support of fiber web.

As known from the prior art fiber web making processes typically comprise an assembly formed by a number of apparatuses arranged consecutively in the process line. A typical production and treatment line comprises a head box, a wire section and a press section as well as a subsequent drying section and a reel-up. The production and treatment line can further comprise other devices and sections for finishing the fiber web, for example, a sizer, a calender, and a coating section. The production and treatment line also comprises at least one slitter-winder for forming customer rolls as well as a roll packaging apparatus.

As is known in the prior art, in some applications of drying, or carrying, etc. of a fiber web, for example a paper or board web, a device is needed which is capable of correcting any factors that may be related to the run of the web in the transverse direction of the machine, such as wrinkles, folds, and instabilities of the web. One way to solve these problems is to produce a web curved in the transverse direction of the machine. In contact-free treatment of a web, this can be achieved by creating a curved carrier face for the air nozzles that are used. Airborne web drying is used, e.g., in various coating applications, in particular in applications in which both sides of the web are treated at the same time.

With regard to the prior art related to airborne web drying, reference is made to publication EP 0 507 218 A1, which describes a dryer section including a contact-free web reversing device having a curved form so that the web is turned in the middle of the reversing curve, i.e., corresponding to the middle area of the web, to a greater extent than in lateral areas of the web. Further, in the device, the blow pressures are selected to be higher in the middle area than toward edges areas, so that the web obtains a curved form in the cross direction of the machine. The curved form of the blow pressure profile can be provided either by a web reversing device that is accomplished with a curved form or by regulating the blow pressures accordingly.

In publication EP 0 548 419 A1 is disclosed a device including a nozzle part formed in a manner so as to be adjustable, by means of support adjustable bolts attached at each end and in the middle to a base frame and to the nozzle, in a curved position in the cross direction of the machine. In this known structure the nozzle is bendable against the base frame.

In publication EP 0 726 220 B1 is disclosed a method for contact-free treatment of a running web by air blowing, said method comprising the steps of blowing air to treat the web through a nozzle-carrier-face unit which comprises a carrier face and which is fastened to a stationary frame part with opposite side walls arranged in a direction transverse to the running direction of the web, said stationary frame part operating as an air supply chamber, and regulating the profile of said nozzle-carrier-face unit in the transverse direction by adjustably bending said nozzle-carrier-face unit to provide a curved form for said carrier face in the transverse direction, wherein said nozzle-carrier-face unit is adjustably bent while being situated inside said frame part between said opposite side walls and while being displaced relative to said side walls. A device for contact-free treatment of a running web, comprising at least one stationary frame part operating as an air supply chamber comprising opposite side walls, a nozzle-carrier-face unit comprising a carrier face, wherein the opposite side walls of said at least one frame part and said nozzle-carrier-face unit extend substantially in a direction transverse to the running direction of the web, means for coupling said nozzle-carrier-face unit to said at least one frame part, and means for adjustably deflecting said nozzle-carrier-face unit relative to said at least one stationary frame part to provide a curved form for said carrier face in the transverse direction, wherein said nozzle-carrier-face unit is situated inside said at least one stationary frame part between said opposite side walls such that the nozzle-carrier-face unit is displaceable within said at least one stationary frame part and relative to said walls, and said adjustably deflected nozzle-carrier-face unit is fastened to said side walls by means of said coupling means.

With further regard to the prior art, reference is made to publication EP 1218589 A1, in which is disclosed an airborne web-drying apparatus for drying a travelling coated fiber web, such as a paper or board web, which apparatus comprises a nozzle arrangement including: an overpressure nozzle extending across the web and having on both sides of the nozzle, i.e. on the entrance and exit sides of the nozzle as seen in the web travel direction, a nozzle orifice arrangement extending across the web and comprising one nozzle slot or a row of successive nozzle orifices extending across the web, and which nozzle orifice arrangements are arranged to blow drying air jets obliquely against each other, or which nozzle orifice arrangements are arranged to blow drying air jets which are guided against each other with the aid of curved Coanda-surfaces, and at least one direct impingement nozzle extending across the web, in which direct impingement nozzle a plurality of nozzle slots or nozzle orifices are formed for blowing drying air mainly perpendicularly against the web, wherein said direct impingement nozzle is combined with said overpressure nozzle on the exit side or on the entrance side thereof in order to form a nozzle assembly such that no discharge passage for discharging wet air is formed between said direct impingement nozzle and said overpressure nozzle; the apparatus comprises on each side of the web two or more of said nozzle assemblies spaced-apart from each other in the web travel direction, wherein the gap between two adjacent nozzle assemblies on each side of the web forms a discharge passage for discharging wet air; and the nozzle assemblies are arranged on opposite sides of the web so that opposite each discharge passage between two adjacent nozzle assemblies on one side of the web there is on the other side of the web a nozzle assembly.

In publication DE 202012005534 U1 is disclosed a variable air nozzle for treating a fiber web, having a plurality of longitudinally extending air chambers with longitudinal side walls, in which air supply holes are formed, and a covering slide, which has openings functioning with the air supply holes, wherein the air supply holes can be blocked by displacement of the slide.

Disadvantages of the prior art known arrangements are in some cases occurring mechanical uncertainties due to possibly used complicated structures and possible limitations in adjustment. In known arrangements of the prior art there has sometimes also been difficulties to simultaneously achieve optimal curvature adjustability combined with efficiency.

SUMMARY OF THE INVENTION

An object of the invention is to provide a nozzle of a device for contact-free treatment of a running fiber web, in which the disadvantages of prior art are eliminated or at least minimized.

A particular object of the invention is to create a simple and easily adjustable nozzle.

It is a further non-limiting object of the present invention to provide a new and improved nozzle in which the regulation of the curved form can be carried out readily with simultaneous efficiency.

In order to achieve the above objects and those that will become apparent later the nozzle according to the invention is mainly characterized in that a U-shaped inner part is located inside a main frame part and that between inner upper surfaces of the main frame part and outer upper surface of the U-shaped inner part at least one adjustment mechanism having a screw and a bushing attached by a welding to the inner upper surface of the main frame part and the outer upper surface of the U-shaped inner part wherein the mechanism is located at least partially to open or to close the at least one opening.

In this description and the claims the word upper has been used as assuming that the nozzle is below the fiber web. It should be noted that the location can also be vice versa or oblique in respect of the fiber web and the word upper should be understood correspondingly. By longitudinal direction of the nozzle is meant direction crosswise in respect of the main travel direction of the fiber web. It should be also noted that instead of air other gaseous substances can be used as the blow medium.

According to the invention the nozzle of a device for contact-free treatment of a running web comprises a main frame part forming an outer part of the nozzle, which two side chambers on each longitudinal side of the nozzle, each side chamber comprising at least one nozzle opening for the air blow towards the fiber web, an air channel, through which the air is lead to the side chambers, located at least partially between the side chambers, which air channel is U-shaped and comprises side walls with at least one opening on each side wall for leading the air into the side chambers, wherein a U-shaped inner part is located inside the main frame part and that between inner upper surfaces of the main frame part and outer upper surface of the U-shaped inner part at least one adjustment mechanism comprising a screw and bushings attached by a welding at each end to corresponding upper surface is located at least partially to open or to close the openings.

According to an advantageous feature of the invention the nozzle comprises several adjustment mechanisms located apart in the longitudinal direction of the nozzle.

According to an advantageous feature of the invention the nozzle is a longitudinally extending beam like structure.

According to an advantageous feature of the invention by the adjustment mechanism the distance between the outer upper surface of the U-shaped inner part and the inner upper surface the main frame part is adjusted.

According to an advantageous example of the invention the nozzle is formed as welded construction comprising a U-shaped inner part and a main frame part between the adjustment mechanism, comprising a screw and bushings, is attached by welding at each end. When the screw is turned the inner U-shaped part opens/closes the openings in side walls of an outer U-shaped part of the main frame part, whereby the air blows can be regulated without changing the height of the nozzle. Advantageously there can be also dividing plates provided in order to divide the nozzle into sections in longitudinal direction of the nozzle, i.e. in cross-direction of the direction of travel of the fiber web. According to a further advantageous feature the nozzle may comprise cross-screws with movement clearance attached between the walls of the inner U-shaped part by which the bending of the nozzle can be adjusted in travel direction of the fiber web.

According to an advantageous example of the invention at least one of the side walls of the outer U-shaped part of the main frame part comprises longitudinally located, a part spaced openings or a longitudinal opening, which can be opened/closed to any position from fully opened to fully closed by adjusting the location of side walls of the inner U-shaped part. In case the nozzle is divided into sections by the dividing plates, each section is advantageously provided with its adjustment mechanism and thus each section can be adjusted individually. By this the amount of air in the air blow can be adjusted.

According to an advantageous example of the invention the nozzle comprises several spaced apart adjustment mechanisms in longitudinal direction of the nozzle by adjustment of each the curvature of the nozzle in longitudinal direction can be adjusted. Thus the distance between the upper surface of the U-shaped inner part and the upper surface of the U-shaped outer part of the main frame part is adjusted. Correspondingly the distance of the nozzles upper surface from the surface of the fiber web can be adjusted.

Advantageously the nozzle is adjustable during running of the fiber web.

By the invention is achieved an adjustable nozzle with simple construction in which the limitations for adjustability are decreased when compared to nozzles known from prior art. The nozzle has an adjustable curvature and efficient adjustment of air blows. Further the height and/or obliqueness of the nozzle in respect of the fiber web can be optimized in mounting the nozzle to the corresponding device of the fiber web production line.

The nozzle in itself has thus the adjustable curvature independent from its support structures, base frames, attachment system etc.

The device in accordance with the invention can be utilized in such nozzle constructions used for contact-free web treatment as are supposed to be bent to a curved form in the cross direction of the machine.

The device in accordance with the invention is particularly suitable for use in various airborne nozzles and especially when a web is dried in connection with two-sided and/or one-sided coating and/or sizing.

In the following, the invention will be described in detail with reference to some preferred exemplifying embodiments of the invention illustrated in the figures in the accompanying drawings. However, the invention is by no means strictly confined to the details of these embodiments alone.

DESCRIPTION OF THE PREFERRED EMBODIMENTS

During the course of this description like numbers and signs will be used to identify like elements according to the different views which illustrate the invention. Repetition of some reference signs have been omitted in the figures for clarity reasons.

Figure 1B:
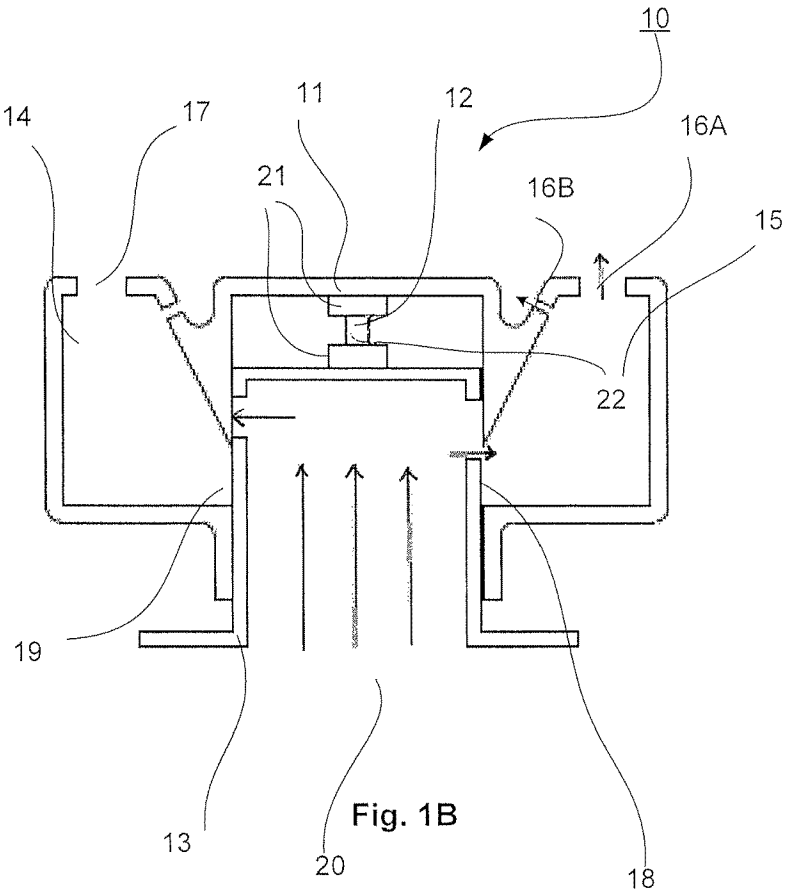
FIGS. 1A-1B is a schematic view of a nozzle according to an advantageous example of the invention as a cross section view.
Figure 1A:
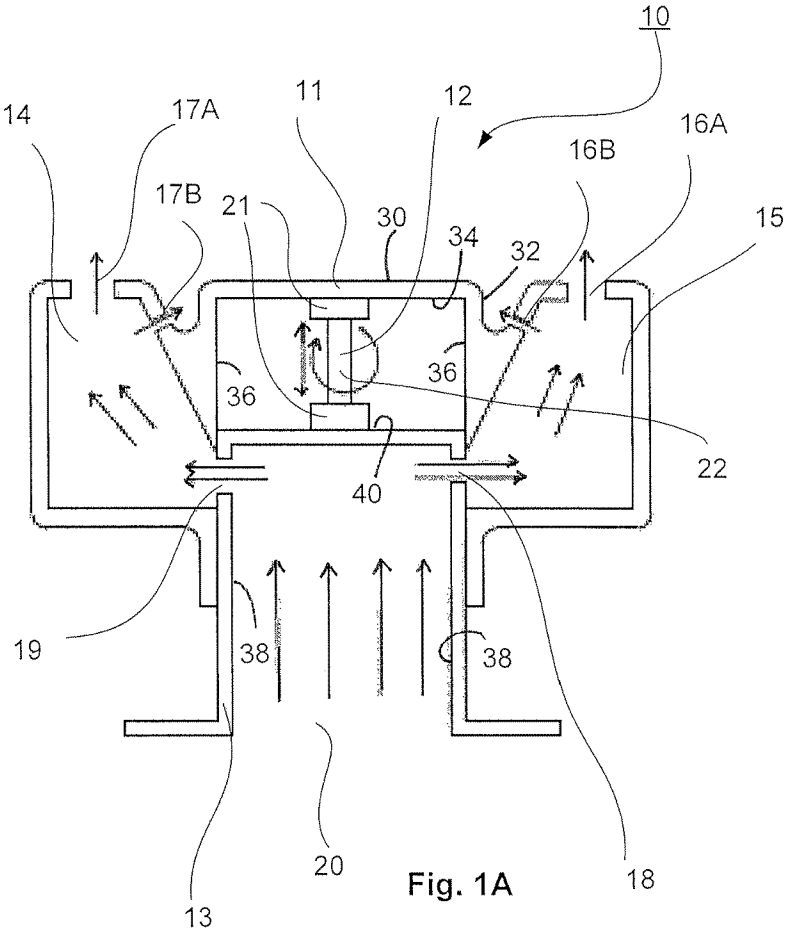
Figure 2:
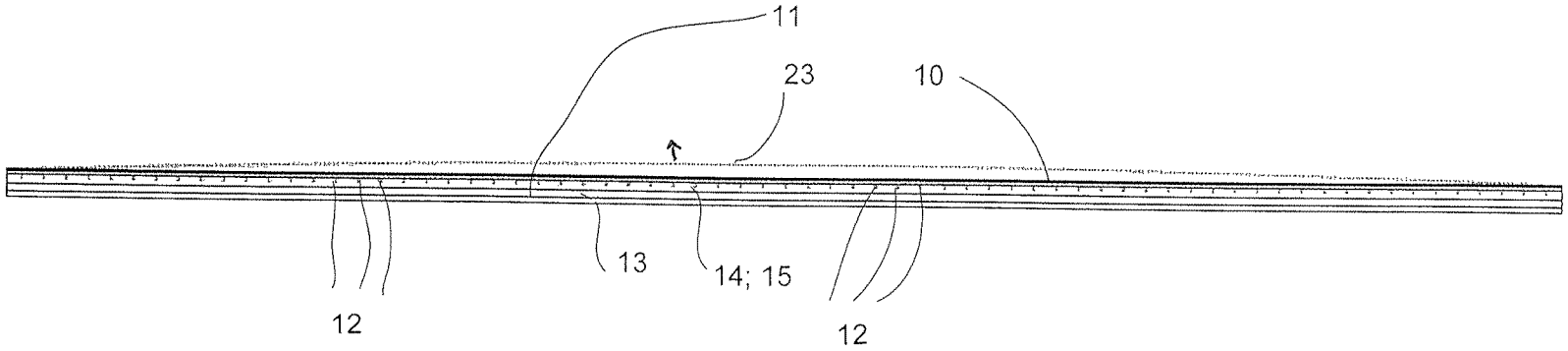
In FIG. 2 is shown a schematic example of a nozzle according to an advantageous example of the invention as a longitudinal view and In FIG. 3 is shown a schematic example of an advantageous application of nozzles according to an advantageous example of the invention in an air turn device of a fiber web production line.

As shown in FIGS. 1A-1B the nozzle 10 comprises a main frame part 11 that forms the outer part of the nozzle 10. The main frame part 11 comprises two side chambers 14, 15 on each longitudinal side of the nozzle 10. Each side chamber 14, 15 comprises nozzle openings 16A, 16B, 17A, 17B for the air blow towards the fiber web (not shown) perpendicularly 16A, 17A and by inclined blows 16B, 17B. The main frame part 11 comprises between the side chamber 14, 15 an air channel 20 through which the air is lead to the side chambers 14, 15. The air channel 20 is formed U-shaped and its side walls have openings 18, 19 for leading the air into the side chambers 14, 15. Inside the main frame part 11 a U-shaped inner part 13 is located. Between the upper surfaces of the main frame part 11 and the U-shaped inner part at least one adjustment mechanism 12 is located for adjusting the location of the side walls of the inner part 13 to open or to close the openings 18, 19 of the main frame part 11 as shown in the FIGS. 1A-1B. In FIG. 1A the openings 18, 19 are fully open so that air is passed from the air channel 20 to each of the side chambers 14, 15 and through each nozzle opening 16A, 16B, 17A, 17B as shown by arrows in the FIG. 1A. In FIG. 1B where the openings 18 and 19 are of different sizes the distance between the upper surfaces of the main frame part 11 and the U-shaped inner part 13 has been adjusted such that the opening 19 on the left hand side in the figure is fully closed and the opening 18 on the right hand side in the figure is partially opened thus air is passed to the right hand side in the FIG. 1B located side chamber 15 and through the nozzle opening 16A, 16B as shown by the arrows in the FIG. 1B. The nozzle 10 may comprise the nozzle openings 16A, 16B, 17A, 17B a single or a double slot opening or advantageously there are several substantially circular nozzle openings 16A, 16B, 17A, 17B located spaced apart in at least one line extending substantially in longitudinal direction of the nozzle 10. In FIG. 2 is shown the nozzle 10 as a longitudinal view. The nozzle 10 comprises the main frame part 11 and its side chambers 14; 15, one of which can be seen in this longitudinal side view of the nozzle 10, and the inner part 13.

There is at least one adjustment mechanism 12 for adjusting the curvature of the nozzle 10, advantageously, as shown in FIG. 2, there are several adjustment mechanisms 12 located apart in the longitudinal direction of the nozzle 10. As can be seen from the figure the nozzle 10 is formed as a longitudinally extending beam like structure. As shown in the figure by dashed line 23 which illustrates mechanical shape of nozzle 10, when the curvature of the nozzle is adjusted by the adjustment mechanism 12. Thus the distance between the upper surface of the U-shaped inner part 13 and the upper surface of the U-shaped part of the main frame part 11 is adjusted to form a spreader. Correspondingly the distance of the nozzle's 10 upper surface from the surface of the fiber web can be adjusted. The amount of air can also be adjusted so there is more air in the middle of the nozzle.

Figure 3:
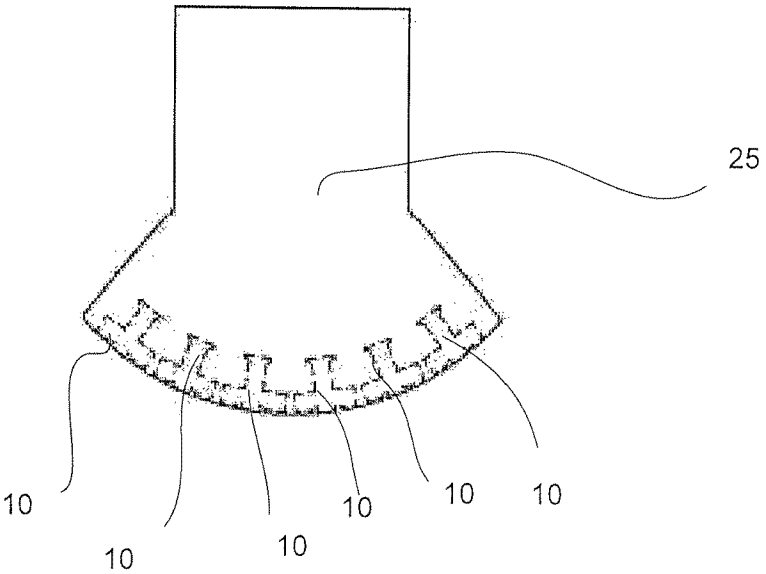

In FIG. 3 is shown an air-turn device 25 of a fiber web production line constructed by the nozzles 10 according to the invention. As can be seen the nozzles 10 are located next to each other in curved positions, the curvature can further more accurately be adjusted by the adjustment mechanisms 12 of the nozzles 10.

Figure 4:
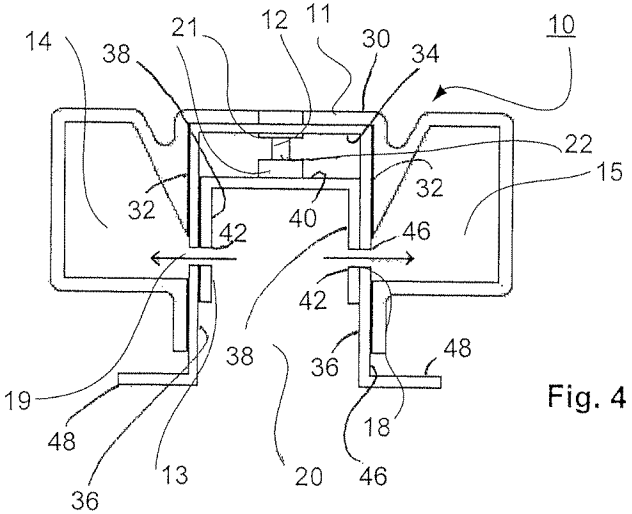
In FIG. 4 is shown another schematic example of a nozzle according to an advantageous example of the invention as a cross section view.

In FIG. 4 is shown another advantageous example of the nozzle 10 comprising a main frame part 11 that forms the outer part of the nozzle 10. The main frame part 11 comprises two side chambers 14, 15 on each longitudinal side of the nozzle 10. Each side chamber 14, 15 comprise nozzle openings 17A, 16A for the air blow towards the fiber web (not shown) perpendicularly.

Figure 5:
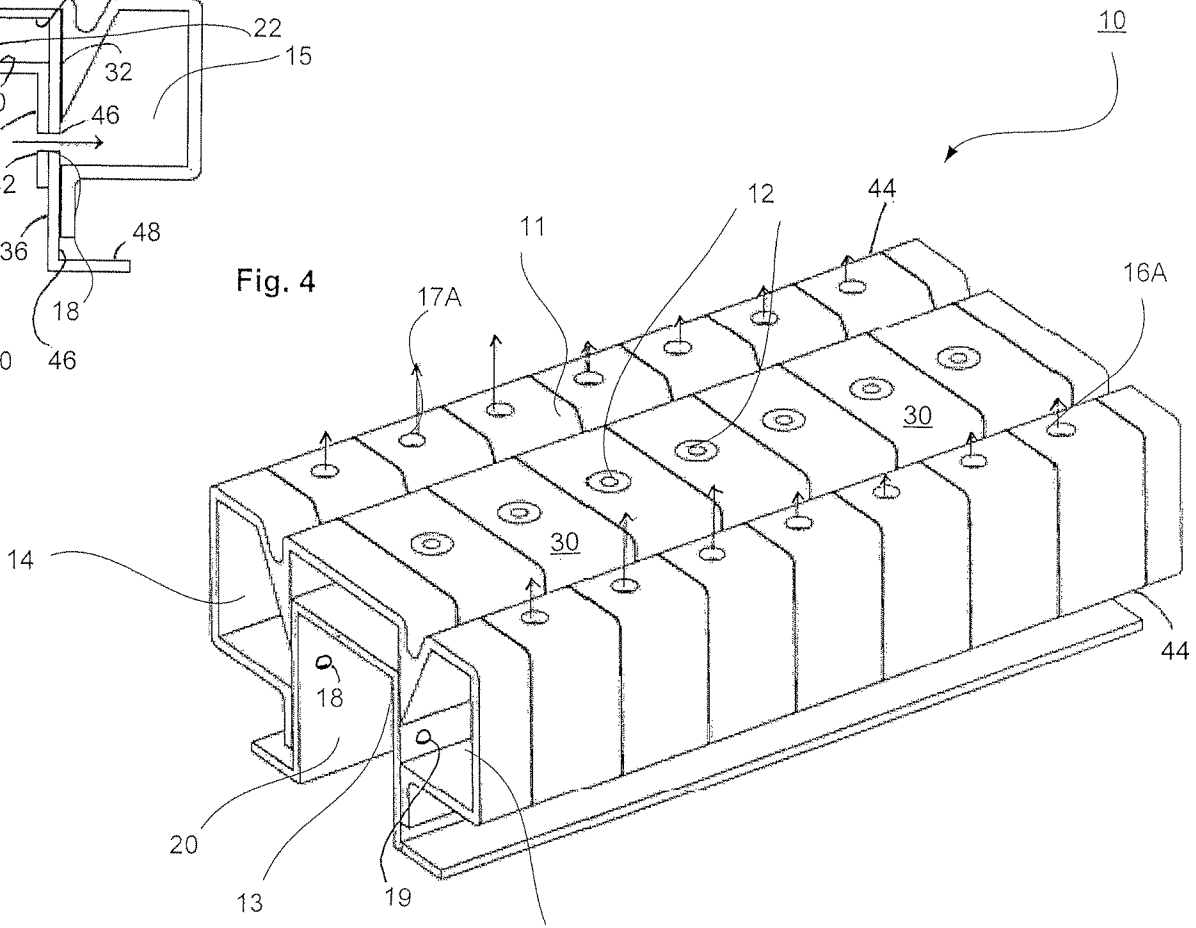
In FIG. 5 is shown schematically the example according to FIG. 4 in a perspective view.

The main frame part 11 comprises between the side chambers 14, 15 an air channel 20 through which the air is lead to the side chambers 14, 15. The air channel 20 is formed U-shaped and its side walls have openings 18, 19 for leading the air into the side chambers 14, 15. Inside the main frame part 11 a U-shaped inner part 13 is located. Between the upper surfaces of the main frame part 11 and the U-shaped inner part at least one adjustment mechanism 12 is located for adjusting the location of the side walls of the inner part 13 to open or to close the openings 18, 19 of the main frame part 11. In FIG. 4 the openings 18, 19 are fully open so that air is passed from the air channel 20 to each of the side chambers 14, 15 and through each nozzle opening 17A, 16A as shown by arrows in FIG. 5. In this example the nozzle 10 comprises several substantially circular nozzle openings 16A, 17A located spaced apart in one line for each side chamber 14, 15 extending substantially in longitudinal direction of the nozzle 10. There is at least one adjustment mechanism 12 for adjusting the curvature of the nozzle 10, advantageously, as shown in FIG. 5, there are several adjustment mechanisms 12 located apart in the longitudinal direction of the nozzle 10. As can be seen from FIG. 5 the nozzle 10 is formed as a longitudinally extending beam like structure. The curvature of the nozzle 10 can be adjusted by the adjustment mechanism 12. Thus the distance between the upper surface of the U-shaped inner part 13 and the upper surface of the U-shaped part of the main frame part 11 is adjusted. Correspondingly the distance of the nozzle's 10 upper surface from the surface of the fiber web can be adjusted.

According to the present invention the nozzle 10 can be formed as a welded construction, and comprises a U-shaped inner part 13 and a main frame part 11 between which the adjustment mechanism 12, comprises a screw 22 and bushings 21, the bushings are attached by a welding, one to the main frame part and one to the U-shaped inner part 13 in FIGS. 1A and 1B. The bushings 21 which are welded to the main frame 11 are threaded and the bushings 21 which are welded to the U-shaped inner part 13 are attached to the screw 22 so that the screw can rotate but is retained in the bushing so that rotation of the screw 22 raises or lowers the U-shaped inner part. When the screw is turned the inner U-shaped part 13 opens/closes the openings 18, 19 in the side walls of the main frame part 11 by movement of corresponding openings 18A and 19A in the U-shaped part as shown in FIG. 5, whereby the air blows can be regulated without changing the height of the nozzle 10. As shown in FIG. 1B the holes 18A and 19A may be of different sizes. Advantageously there can be also dividing plates (not shown) provided in order to divide the nozzle into sections in longitudinal direction of the nozzle, i.e. in cross-direction of the direction of travel of the fiber web. In case the nozzle is divided into sections by the dividing plates, each section is advantageously provided with its adjustment mechanism and thus each section can be adjusted individually. The nozzle 10 may comprise cross screws (not shown) with movement clearance attached between the walls of the inner U-shaped part 13 by which the bending of the nozzle 10 can be adjusted in travel direction of the fiber web.

The main frame 11 part forming an outer part of the nozzle 10 and has portions 30 which face the web, and wherein the main frame has two longitudinal sides 32 extending in a longitudinal direction across the running web. The two side chambers 14, 15 are located one on each of the two longitudinal sides 32 of main frame part 11. The two side chambers have portions forming an opening facing 18, 19 a corresponding one of the two longitudinal sides 32 of main frame part 11. The main frame part has an inner upper surface 34 between the two longitudinal sides 32. The main frame defines a U-shaped air channel 20 through which air is lead to the side chambers 14, 15 and two downwardly extending inner side walls 36 joined by the inner upper surface 34, each side wall having at least one first opening 18, 19 for leading air into one of the two side chambers 14, 15. The U-shaped inner part has two downwardly extending side walls 38 joined by an outer upper surface 40, each side wall having portions forming at least one second opening 42 for leading air into one of the two the side chambers 14, 15. The adjustment mechanism 12 is between inner upper surface 34 of the main frame part 11 and the outer upper surface 40 of the U-shaped inner part 13. The main frame part may be divided into a plurality of segments 44 which are each adjustable by one of a plurality of adjustment mechanisms. FIG. 4 shows an inner U-shaped liner 46 which extends upwardly from at least one mounting flange 48 and lines, and forms part of the inner upper surface 34 and the two longitudinal sides 32 of the main frame 11.

In this description and the following claims by fiber webs are meant, for example, paper and board webs.

I claim:

1. Nozzle of a device for contact-free treatment of a running web, comprising:

a main frame part forming an outer part of the nozzle and having portions which face the web, and wherein the main frame has two longitudinal sides extending in a longitudinal direction across the running web, the main frame having portions forming two side chambers one on each of the two longitudinal sides of the main frame part, each side chamber having at least one a nozzle opening for air to blow towards a fiber web;

wherein each of the two side chambers have portions forming a first opening facing a corresponding one of the two longitudinal sides of the main frame part;

wherein the main frame part has an inner upper surface between the two longitudinal sides;

wherein the main frame defines a U-shaped air channel through which air is lead to the side chambers, the U-shaped air channel located at least partially between the two side chambers and having two downwardly inner side walls joined by the inner upper surface, each side wall having portions forming at least one first opening for leading air into one of the two side chambers;

a U-shaped inner part located at least partially inside the main frame part in the U-shaped air channel, U-shaped inner part and having two downwardly extending side walls joined by an outer upper surface, each side wall having portions forming at least one second opening for leading air into one of the two side chambers;

at least one adjustment mechanism between the inner upper surface of the main frame part and the outer upper surface of the U-shaped inner part;

wherein the at least one adjustment mechanism comprises, a first threaded bushing welded to the main frame part inner surface, a second bushing welded to the U-shaped inner part outer upper surface and a screw connecting the first bushing and the second bushing so that rotation of the screw opens and closes, at least partially, an air passage through at least one of two side chambers first openings and one of the side wall second openings for leading air into at least one of the two side chambers.

2. The nozzle of claim 1 further comprising a plurality adjustment mechanism spaced apart in the longitudinal direction along the main frame of the nozzle.

3. The nozzle of claim 1 wherein the nozzle forms a beam which extends in the longitudinal direction.

4. The nozzle of claim 1 wherein the screw is rotatable to changed the distance between the outer upper surface of the U-shaped inner part and the inner upper surface of the main frame part.

5. The nozzle of claim 1 wherein the side wall second openings of the U-shaped inner part are of different sizes so that air flow into the two side chambers is different.

6. The nozzle of claim 1 wherein at least one of the two side chambers has at least two nozzles opening for air to blow towards the fiber web.

7. The nozzle of claim 6 wherein at least two nozzles opening for air to blow towards the fiber web are arranged to blow air in diverging directions.

8. The nozzle of claim 1 wherein portions of the two longitudinal sides of the main frame engage and are slidable along the U-shaped inner part, two downwardly extending side walls to seal the mainframe to the U-shaped inner part.

9. The nozzle of claim 1 wherein the main frame has portions forming an opening over each screw so that the screw can be turned from the main frame part portions which face the web.

10. The nozzle of claim 1 wherein the main frame part is divided into a plurality of segments which are each adjustable by one of a plurality of adjustment mechanisms.

11. The nozzle of claim 1 wherein the main frame U-shaped air channel through which air is lead to the side chambers has an inner U-shaped liner which extends upwardly from at least one mounting flange and lines, and forms part of the inner upper surface and the two longitudinal sides of the main frame.

12. The nozzle of claim 11 wherein the U-shaped inner part is located at inside the main frame part in the U-shaped air channel and the U-shaped inner part downwardly extending sides do not extend to the at least one mounting flange.

* * * * *